United States Patent [19]

Janson

[11] 4,296,507

[45] Oct. 27, 1981

[54] SAUNA HEATING UNIT AND SHIELD THEREFOR

[75] Inventor: Mats O. Janson, Port, Switzerland

[73] Assignee: Tylo Sauna S.A., Biel-Bienne, Switzerland

[21] Appl. No.: 89,135

[22] Filed: Oct. 29, 1979

[30] Foreign Application Priority Data

Nov. 8, 1978 [SE] Sweden ..... 7811514

[51] Int. Cl.[3] ..... A61H 33/06

[52] U.S. Cl. ..... 4/524; 126/141

[58] Field of Search ..... 4/524, 520, 526, 533; 126/141

[56] References Cited

U.S. PATENT DOCUMENTS

| | | | |
|---|---|---|---|
| 27,886 | 4/1860 | Card | 126/141 |
| 419,704 | 1/1890 | McMahen | 126/141 |
| 1,318,216 | 10/1919 | McElveen | 126/141 |
| 2,825,326 | 3/1958 | Flynn, Jr. | 126/141 |
| 3,778,593 | 12/1973 | Wikstrom | 4/524 |
| 4,164,931 | 8/1979 | Jenkins | 126/141 |

FOREIGN PATENT DOCUMENTS

| | | | |
|---|---|---|---|
| 155426 | 12/1920 | United Kingdom | 126/141 |

*Primary Examiner*—Henry K. Artis
*Attorney, Agent, or Firm*—Holman & Stern

[57] ABSTRACT

The invention refers to a shield arranged at a distance above a sauna heating unit and attached to said unit by means of downwardly directed supporting members. The shield is arranged at an angle to the horizontal plane and its object is to guide the stream of hot air and possible steam generated when pouring water over the heated stones or similar in the sauna heating unit obliquely upwards, i.e. out in the sauna room towards the persons in the sauna room.

6 Claims, 6 Drawing Figures

SAUNA HEATING UNIT AND SHIELD THEREFOR

BACKGROUND OF THE INVENTION

A sauna heating unit irrespective of what type of power source is used, electricity, wood, gas etc. generates owing to the chimney effect or a fan a very hot air stream (200°-600° C.) straight and somewhat obliquely upwards. This hot air does of course heat the ceiling of the sauna room, which usually is made of a burnable material, e.g. wood. For preventing the ceiling from being damaged, discoloured, carbonized and/or ignited or smelted if it is made of a plastics material it has hitherto been necessary to build the sauna rooms with such a large distance between the heating source and the ceiling, that these risks do not occur.

This involves either that a relatively large ceiling height is required, which means that there can be problems finding a space for building the sauna, or the heating effect has to be reduced. International security regulations (CEE) for saunas state that the ceiling height may not be less than 190 cm. Since most houses nowadways are built without a basement many people wish to build their saunas on the upper floor, which often has a pitched roof and/or low ceiling heights.

In the Swiss patent specification No. 469.484 is shown a plate of a heat-resistant material attached close to the ceiling above a sauna heating unit, said plate guiding the stream of hot air out towards the sauna room. This plate must owing to the great distance from the sauna heating unit, have a very large area in order to be effective and besides that it means a complication at the building of the sauna room.

In the Swedish patent specification No. 359.026 is shown a sauna heating unit with a hinged flap which when raised automatically returns to its position substantially covering the upper end of the aggregate. The only purpose of the flap is to prevent heat radiation towards the ceiling at normal ceiling heights in the sauna room for sauna heating units without a stone store. It would not serve any purpose at the generation of steam because the flap would cover a possible stone store and make the pouring of water over the stones impossible.

In the Norwegian patent specification No. 72.084 a wood heated sauna oven is shown, immediately above which a shield arranged to guide the hot air downwards is attached. It is true that the heat radiation towards the ceiling is reduced, but no significantly increased effect of the steam generated when pouring water over the heated stones is achieved.

BRIEF SUMMARY OF THE INVENTION

The object of the invention is to provide a device, which enables the installation of a sauna where the ceiling height is considerably lower than earlier stipulated, without causing any damage to the ceiling and without causing the temperature of the low ceiling exceeding any critical limit (according to the CEE-regulations the maximum admitted ceiling temperature is 140° C.). The feeling of heat from the steam generated when pouring water over the stones will be increased, and the temperature in the sauna can be lowered and still keep the same feeling of heat for the persons in the sauna.

This has according to the invention been achieved by the fact that said shield is detachably attached to the sauna heating unit at a distance above it by way of upright members, that the shield is arranged at an angle to the horizontal plane for directing the stream of hot air and possible steam obliquely upwards towards the upper part of the sauna room.

An important advantage of the invention is that the heat effect of the steam is considerably increased. The steam generation is achieved by pouring water on the heated stones of the sauna heating unit, whereby the water is immediately vaporized. With conventional sauna heating units the steam rises to the ceiling, follows the ceiling to the rear wall, then sinks downwards in the sauna room and with a decreased effect is spread among the persons in the sauna. With the device according to the invention the steam immediately hits the shield, which directs the steam into the sauna room, i.e. without taking the long route via the ceiling and the rear wall. With the same water amount of power consumption a stronger and more rapid heat effect of the steam is achieved. The temperature of the sauna can thus be lowered still keeping the same heat effect.

The shield according to the invention also serves as a protection in case an article of clothing or similar article should fall down on the sauna heating unit when washings are dried in the sauna and will thereby prevent ignition. In case an article should still be ignited the shield leads away the flames from the adjacent walls and the ceiling.

With the shield according to the invention an unnecessary heating of the adjacent walls and the ceiling is avoided.

BRIEF DESCRIPTION OF THE SEVERAL VIEWS OF THE DRAWINGS

The invention will now be further described with reference to some embodiments shown in the accompanying drawings, in which.

DETAILED DESCRIPTION

Figure 1:
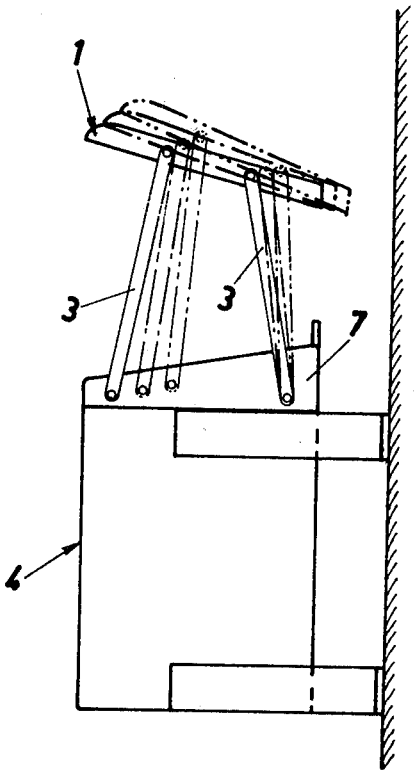
FIG. 1 is a schematic side view of a sauna heating unit provided with a shield according to the invention.
Figure 2:
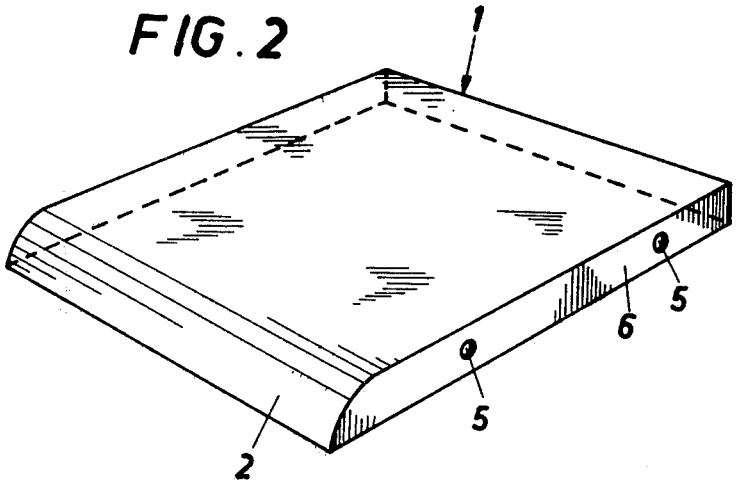
FIG. 2 is a perspective view of the shield according to FIG. 1.

The shield 1 according to FIGS. 1 and 2 is box-shaped with three vertical relatively short walls. At the side facing the sauna room the shield 1 has a downward curved portion 2. The shield 1 is by means of four upright members 3, two on each side, mounted at a distance above a sauna heating unit 4. The upright members 3 are with one and attached, e.g. screwed, in holes 5 in the opposite side walls 6 of the shield and with the other end in holes in the upstanding side walls 7 of the sauna heating unit 4. A plurality of holes can be arranged in the side walls 7 for the front pair of upright members 3, whereby it is possible to adjust the angle of inclination of the shield 1, as is indicated with dash-dotted lines in FIG. 1. The shield 1 shall be directed obliquely upwards for providing the desired effect, at which the stream of hot air and steam is directed out in the sauna room towards the persons therein. The downward bent front edge 2 of the shield 1 as well as the downwards directed side walls prevent the hot air from immediately rising upwards along the side edges of the shield and thus provide a better spreading of the hot air in the sauna room. The side of the shield facing the sauna heating unit can possibly be provided with guide means (not shown) diverging towards the front edge to further improve the spreading of the hot air.

Figure 3:
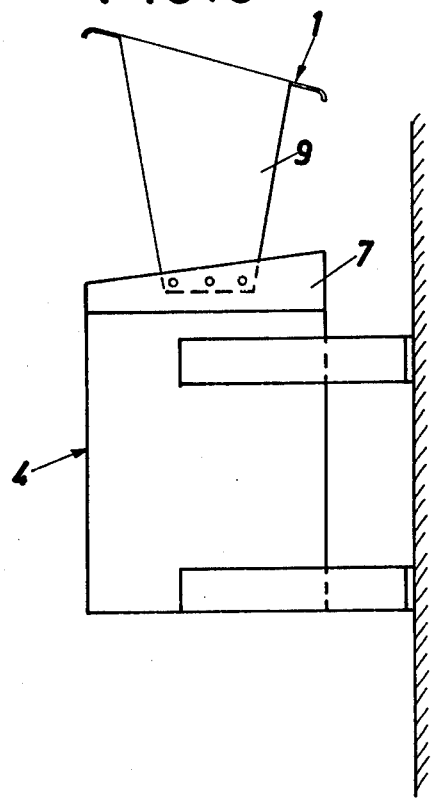
FIG. 3 is a schematic side view of a sauna heating unit provided with a shield according to another embodiment.
Figure 4:
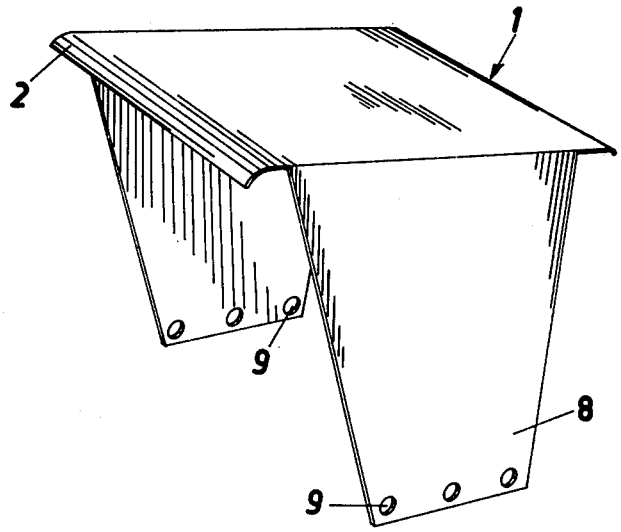
FIG. 4 is a perspective view of the shield according to FIG. 3.

In the embodiment shown in FIGS. 3 and 4 the shield 1 is provided with downward bent vertical side portions 8 of considerable length, said side portions 8 at its lower edge being provided with holes 9 for attaching the shield to the side walls 7 of the sauna heating unit 4. The front and back edges of the shield are curved downwards for guiding the hot air in the way desired. The side portions 8 prevent the hot air from streaming sideward and thus the stream of hot air is directed forward, i.e. towards the persons in the sauna room.

Figure 5:
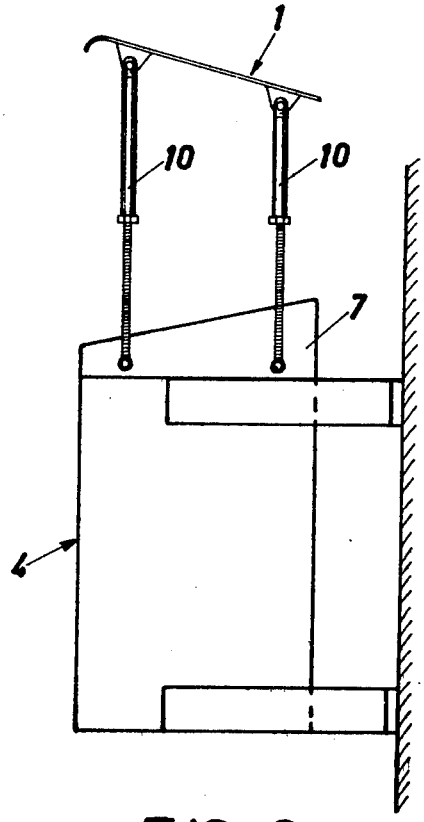
FIG. 5 is a schematic side view of a sauna heating unit provided with a shield according to a further embodiment.
Figure 6:
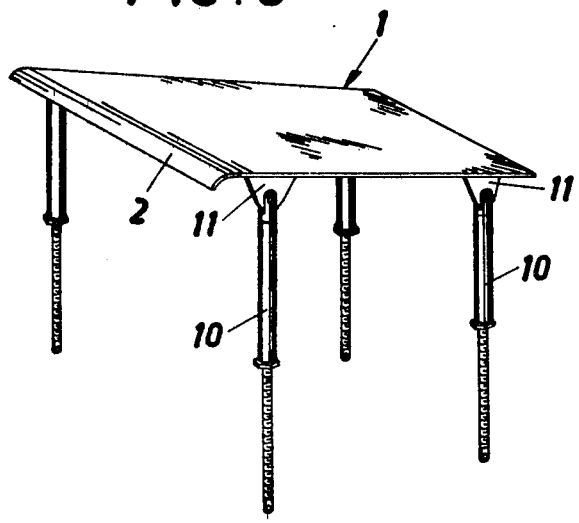
FIG. 6 is a perspective view of the shield according to FIG. 5.

In the embodiment shown in FIGS. 5 and 6 the shield 1 is supported by four telescopic members 10, each being attached to a downward directed lug 11 of the shield 1 and to the side walls 7 of the sauna heating unit 4. It is by means of these telescopic members 11 easy to provide a height adjustment of the shield 1 and an adjustment of the angle of inclination thereof.

The shield 1 is made of a heat resistant material, e.g. sheet metal or an appropriate plastic material.

The invention is of course not limited to the embodiments described above and shown in the drawings but can be modified within the scope of the claims.

What I claim is:

1. A sauna heating unit having a shield for guiding the stream of hot air from said unit into the sauna room comprising a substantially planar sheet member of heat resistant material detachably supported on the sauna heating unit in spaced relationship directly above it, upright members attached to said sheet member and said sauna unit to support said sheet member, said sheet being arranged at an angle to the horizontal plane for directing the stream of hot air from the sauna heating unit obliquely upwards into the sauna room, said sheet member having a shape and dimensions so that it covers an area corresponding to at least a substantial portion of the upper open end of the sauna heating unit.

2. A sauna heating unit having a shield according to claim 1, wherein said upright members are adjustable so that said angle of said sheet member may be adjusted.

3. A sauna heating unit having a shield according to claim 1, wherein said sheet member has a downwardly bent portion at least along its front edge nearest the central portion of the sauna room.

4. A sauna heating unit having a shield according to claim 2, wherein said upright members are telescopic members adapted to adjust said angle of said sheet member.

5. A sauna heating unit having a shield according to claim 1, wherein said sheet member is substantially rectangular and the front edge nearest the center of the sauna room is curved downwardly, and further comprising side walls depending from the edges adjoining said front edge.

6. A sauna heating unit having a shield according to claim 5, wherein said depending side walls are substantially planar and comprise said upright members, the width of said side walls tapering to a smaller dimension at the lower edge portion than at the upper portion, and the rear edge opposite said front edge is curved downwardly.

* * * * *